US005317771A

United States Patent [19]

Cook

[11] Patent Number: 5,317,771

[45] Date of Patent: Jun. 7, 1994

[54] HEADREST COVER

[75] Inventor: William J. Cook, Cincinnati, Ohio

[73] Assignee: Ohio Medical Instrument Company, Cincinnati, Ohio

[21] Appl. No.: 43,015

[22] Filed: Apr. 5, 1993

[51] Int. Cl.[5] ..... A47G 9/00

[52] U.S. Cl. ..... 5/637; 5/622; 128/845

[58] Field of Search ..... 128/845; 5/637, 640, 5/636, 622, 638; 297/220, 227, 391, 411; 403/24, 274; 135/71, 72, 73

[56] References Cited

U.S. PATENT DOCUMENTS

| | | | |
|---|---|---|---|
| 933,471 | 9/1909 | Leahy | 5/640 |
| 1,232,057 | 7/1917 | Lineback | 135/73 |
| 1,453,790 | 5/1923 | Glowacki | 135/73 |
| 1,957,473 | 5/1934 | Pirtle et al. | 135/73 |
| 4,545,572 | 10/1985 | Day | 5/637 |
| 5,020,855 | 6/1991 | Lindberg et al. | 297/391 |
| 5,139,310 | 8/1992 | Hoh | 297/391 |
| 5,214,815 | 6/1993 | Agbodoe et al. | 5/637 |

OTHER PUBLICATIONS

Drawing No. 4-1-C-1445 dated Apr. 18, 1991 (2 Sheets) Trademark Medical Products; Gel Pad Brochure.

Ohio Medical Instrument Company; Drawing No. 4--1-A-1414 dated Apr. 30, 1990.

*Primary Examiner*—Robert A. Hafer
*Assistant Examiner*—Michael O'Neill
*Attorney, Agent, or Firm*—Wood, Herron, & Evans

[57] ABSTRACT

A headrest cover for a headrest frame wherein the headrest cover has a connector with clips for securing the headrest cover to the headrest frame to prevent torsional motion of the headrest cover with respect to the headrest frame. The connector on the headrest cover further has stop members in contact with the ends of the headrest frame to prevent longitudinal motion of the headrest cover with respect to headrest frame.

13 Claims, 2 Drawing Sheets

HEADREST COVER

BACKGROUND OF THE INVENTION

1. Field of the Invention

The present invention relates generally to the area of medical equipment, and more particularly, to a cover for a surgical headrest which is removably mounted to a headrest frame.

2. Discussion of the Related Art

Various pieces of therapeutic or other medical equipment require support for the patient's head. Such support is typically provided by a metal headrest frame for supporting the head and a headrest cover removably attached to the frame for receiving the head. One cover, manufactured and sold by the assignee of the present invention, is comprised of a gel filled pad having a VELCRO® strip on the back of the pad which joins with a mating VELCRO® strip attached to the headrest frame. In use, the forces applied to the headrest cover by the head of a patient during use have an undesirable tendency to rotate or shift the headrest cover with respect to the headrest frame. The tendency of the headrest cover to rotate or shift represents a potential disruption to the procedure being undergone by the patient, and further represents a potential discomfort to the patient. In addition, the VELCRO® strips have a disadvantage of being difficult to clean and sterilize for subsequent use.

SUMMARY OF THE INVENTION

To overcome the disadvantages of existing headrest designs, the invention provides a headrest cover which is more positively secured to the headrest and is easier to clean and sterilize for subsequent use.

The invention is especially suited for use with a headrest frame mechanically connected to the end of a table or other patient support. The headrest frame is comprised of two L-shaped frame members having their shorter sides joined together to form a U-shaped headrest. The headrest is oriented such that the joined short sides of the L-shaped frame members are directed outwardly from the patient support and the long sides of the L-shaped frame members are directed inwardly toward the patient support. Each of the frame members is curved to correspond generally to the curvatures of a human head. The support receives the patient's head such that the top of the head is supported at the junction of the short sides of the L-shaped frame members.

According to the principles of the present invention and in accordance with the described embodiments, headrest covers are attached to each of the L-shaped frame members. Each of the headrest covers is comprised of a pad for supporting a patient's head and a connector attached to the lower surface of the pad. The connectors have mechanisms for mounting and securing the headrest covers on their respective frame members. Each connector has first and second clips on an outside lateral edge at outer and inner ends, respectively, which hook over an outer and upper edge of the frame member thereby mounting the headrest cover on the frame member. The first lateral edge of the connector extends around the outer edge of the frame member.

Each of the connectors includes a stop member located on the outer end of the connector which extends around the outer end of the respective frame member thereby preventing the headrest cover from sliding toward the inner distal end of the frame member, that is, toward the patient support. Each of the connectors has a third clip located on an inside lateral edge of the inner end of the connector and opposite the first clip, thereby securing the inner distal end of the respective frame members between the first and third clips.

Each of the connectors may include a fourth clip on the inside lateral edge at the outer end of the connector which hooks over the inside edge of the outer end of the frame member thereby securing the frame members at the outer end between the second and fourth clips. Each of the connectors has a second stop member at its inner end which extends around the inner end of the respective frame members to prevent the headrest cover from sliding toward the outer end of the frame members, that is, away from the patient support. The inside lateral edge of each of the connectors extends partially around the inside edge of the frame members.

An advantage of the headrest cover of the present invention is that the clips on the connector secure the headrest cover in place against rotational movement with respect to the frame member. In addition, the stop members secure the headrest cover against longitudinal motion with respect to the frame member. The clips have the advantage of permitting the headrest cover to be easily slid on and off the outer end of the frame member. The connector for the cover does not require any mating pieces such as a VELCRO® strip on the frame member. The pad and connector of the present invention have the further advantage of being easily cleaned and sterilized for subsequent use.

These and other objects and advantages of the present invention will become more readily apparent during the following detailed description taken in conjunction with drawings herein.

DESCRIPTION OF THE DRAWINGS

The accompanying drawings, which are incorporated in and constitute a part of this specification, illustrated embodiments of the invention and, together with the general description given above, and the detailed description below, serve to explain the principles of the invention.

DETAILED DESCRIPTION OF THE INVENTION

Figure 1:
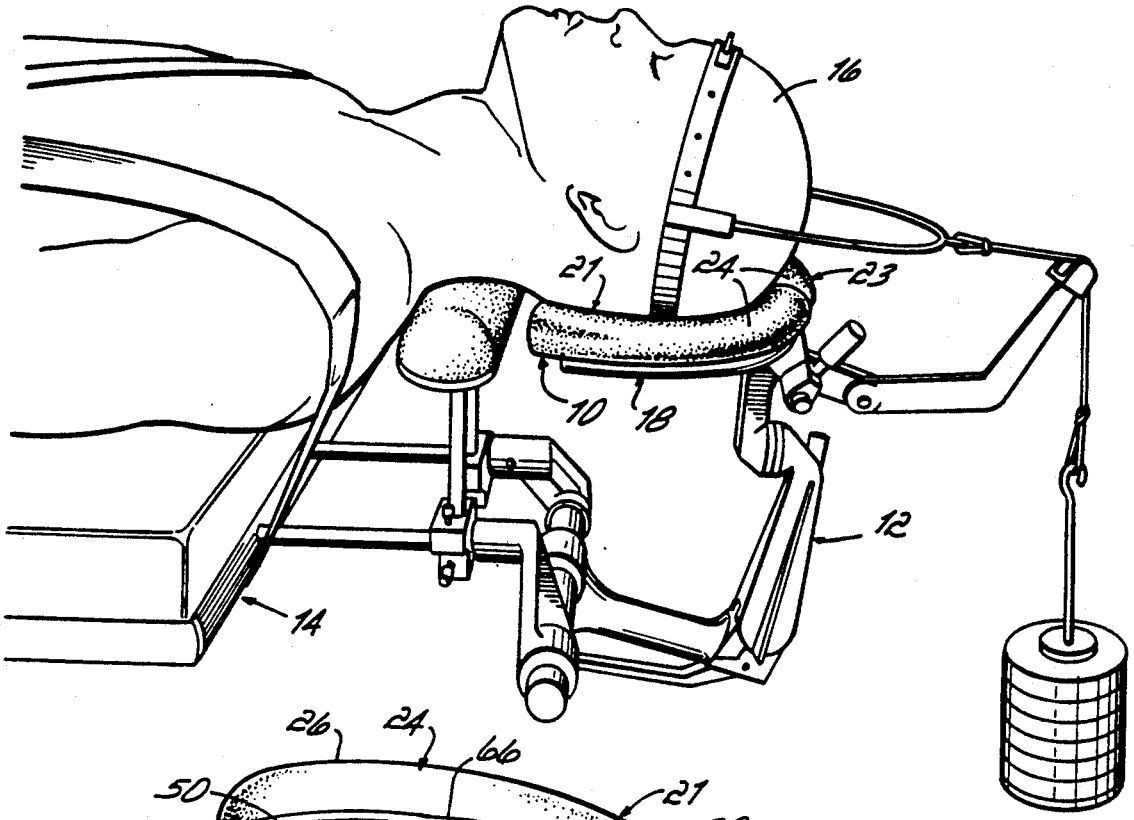
FIG. 1 is a general perspective view illustrating the headrest cover of the represent invention mounted on a headrest frame and supporting a patient 's head on a patient support.
Figure 2:
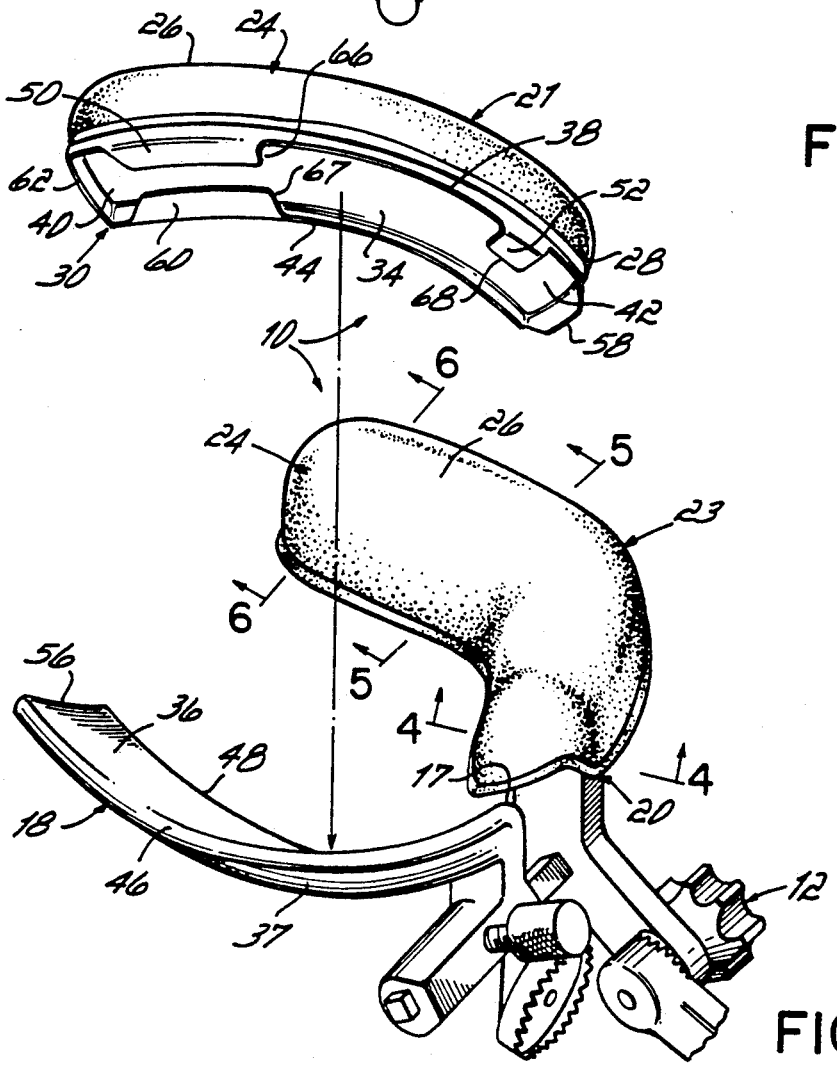
FIG. 2 is an exploded perspective view of a preferred form of the headrest cover of the present invention, illustrating how the headrest cover connects to the headrest frame.

FIG. 1 illustrates the headrest cover of the present invention as utilized with a patient support. The headrest cover 10 is mounted on a headrest frame 12 connected to the end of a table, or patient support 14. The headrest cover 10 is generally configured to comfortably receive a patient's head 16, and the headrest frame 12 is structurally designed to support the head 16. As shown in FIG. 2, the headrest frame 12 is comprised of two L-shaped frame members 18 and 20 having their shorter sides joined together to form a U-shape. The headrest cover 10 is oriented such that the joined short sides of the L-shaped frame members are at an outer end directed away from the patient support 14, and the long sides of the L-shaped frame members have distal inner ends directed toward the patient support 14. Each of the frame members 18 and 20 is curved to correspond generally to the shape of a human head. The headrest frame 1 2 receives the patient's head 1 6 such that the top of the head is supported at the junction of the short sides of the L-shaped frame members at the outer end 17 of the headrest frame 12.

Figure 4:
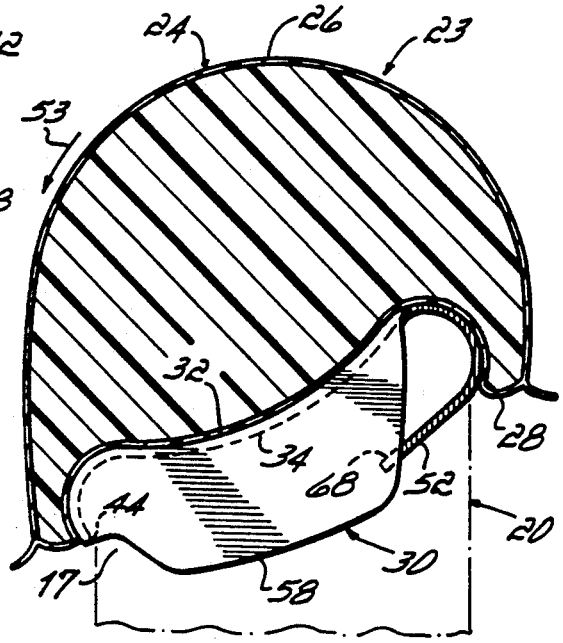
FIG. 4 is a cross-sectional view taken along line 4—4 of FIG. 2 and shows the clips and stop at the outer end of the connector.
Figure 5:
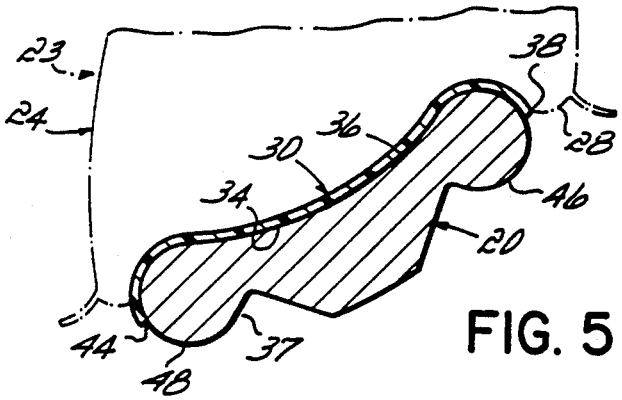
FIG. 5 is a cross-sectional view taken along lines 5—5 of FIG. 2 and illustrating the configuration of the edges of the connector.
Figure 6:
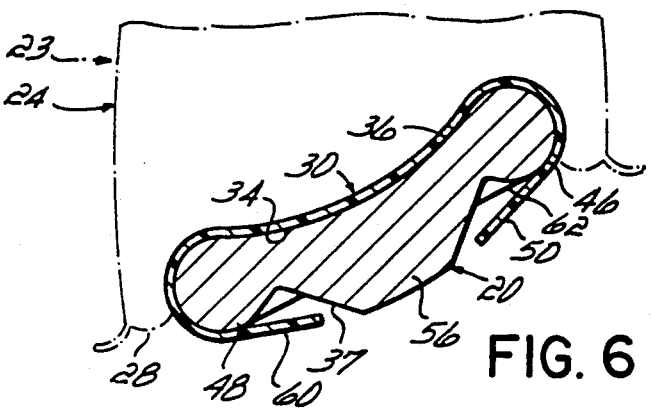
FIG. 6 is a cross-sectional view taken along lines 6—6 of FIG. 2 and illustrating the clips and stop at the inner end of the connector.

The first (left) and second (right) frame members 18 and 20 are mirror image twins of each other; that is, they are dimensionally identical but with opposing left-hand and right-hand geometries. Therefore, the headrest cover 10 includes first (left) and second (right) headrest covers 21 and 23 which are connected to their respective frame members 18 and 20. Similar to the frame members 18 and 20, the first and second headrest covers 21 and 23 are mirror image twins having identical dimensions but opposite lefthand and right-hand geometries to match left-hand and right-hand geometries of their respective frame members. FIGS. 1 and 2 illustrate the structural details with respect to the first headrest cover 21 and FIGS. 4–6 illustrate the structural details of second headrest cover 23. However, except for their mirror image distinctions, first and second headrest covers 21 and 23 are identical.

Figure 3:
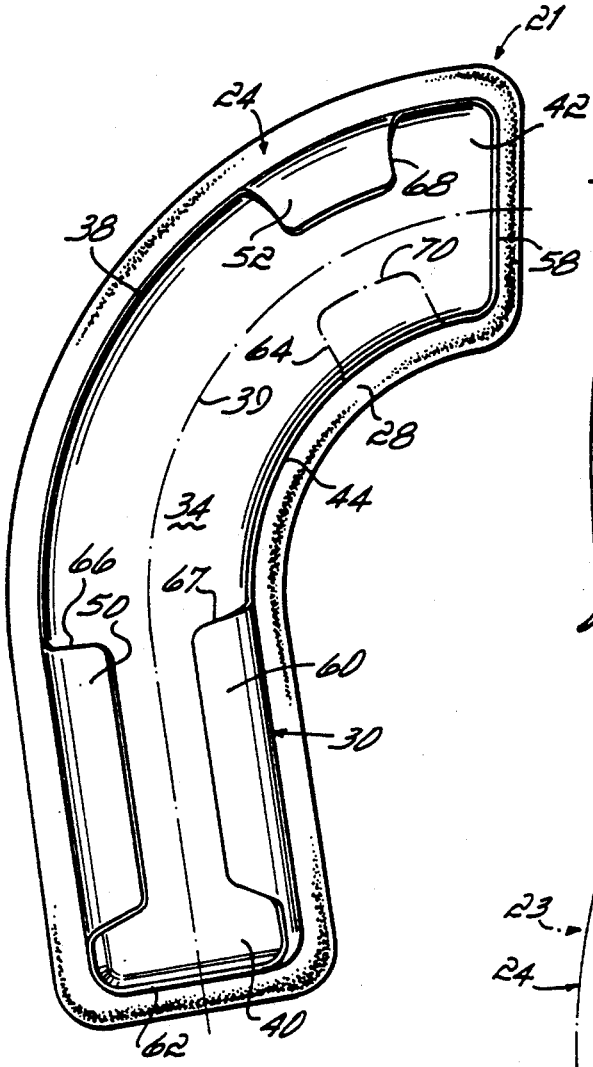
FIG. 3 is a bottom plan view of the headrest cover illustrating the lower side of the connector.

Referring to FIGS. 2–6, the headrest covers 21 and 23, have gel filled pads 24, each having an upper pad surface 26 for comfortably receiving the head 16 and a lower pad surface 28. Each of the headrest covers include a connector 30 with an upper connector surface 32 connected to the lower pad surface 28. Each connector 30 has a lower surface 34 in sliding contact with an upper surface 36 of its respective frame members 18, 20. Referring to FIG. 3, each connector 30 further has an outside lateral edge 38 extending from an inner end 40 of the connector to an outer connector end 42. An inside lateral edge 44, opposite outside lateral edge 38, extends between the inner and outer ends 40 and 42, respectively, of the connector. As shown in FIG. 5, the outside and inside lateral edges 38 and 44, respectively, extend partially over the outside and inside edges 46 and 48, respectively, of the respective frame member. The outside and inside lateral edges 38 and 44 of the connector 30 are approximately parallel to the longitudinal centerline 39 of the connector 30, as shown in FIG. 3.

A first clip 50 is located on the outside lateral edge 38 of each connector 30 proximate the inner connector end 40 and extends from the outside lateral edge 38 around the outside edge 46 and over the lower surface 37 of the respective frame members 18, 20 (FIGS. 2 and 6). A second clip 52 is located on the outside lateral edge 38 of each connector 30 proximate its outer end 42. The second clip 52 extends from the outside lateral edge 38 around the outside edge 46 and over the lower surface 37 of the respective frame members 18, 20.

Given the posture of the patient's head 1 6 with respect to first and second frame members 18 and 20 shown in FIG. 1, placing the head 16 on the headrest covers 21, 23 will result in inwardly directed torsional forces between the headrest covers 21, 23 and the frame members 18 and 20. Consequently, there will be a tendency for the headrest covers 21, 23 to twist in an inward and downward direction, designated by arrow 53 in FIG. 4, generally perpendicular the longitudinal centerline of the frame members. The clips 50 and 52 mount the headrest covers 21, 23 on the frame members 18, 20 in a manner to prevent inwardly directed rotational motion of the headrest covers 21, 23 with respect to the frame members 18, 20.

The frame members 18, 20 have an outer frame end 17 proximate the upper portion of the head 16 and an inner frame end 56. Each connector 30 preferably further includes a first stop member 58 extending from the outer connector end 42 between the inside and outside lateral edges 38 and 44, respectively. The stop member 58 extends along an edge of the outer end 17 of the respective frame members 18, 20 as shown in FIGS. 2 and 4. Depending on the patient activity, the patient may have a tendency to move in a direction generally parallel to the longitudinal axis of the patient support 14. Such motion will have a tendency to move the headrest covers 21, 23 along the longitudinal axis of the frame members 18 and 20. The stop members 58 are effective to prevent longitudinal motion of the headrest covers 21, 23 toward the inner end 56 of the frame members 18, 20 that is, toward the patient support 14.

As shown in FIGS. 2 and 6, each connector 30 preferably further comprises a third clip 60 located on the inside lateral edge 44 proximate the inner end 40 of the connector 30. The third clip 60 extends from the inside lateral edge 44 around the inside edge 48 and over the lower surface 37 of the respective frame members 18, 20. The third clip 60 is effective to secure the inner ends 56 of the frame members 18, 20 between the first and third clips 50 and 60 thereby preventing torsional motion of the headrest covers 21, 23 in either direction with respect to the frame members 18, 20.

As illustrated in FIGS. 2 and 6, each connector 30 preferably has a second stop member 62 extending from its inner end 40 between the first and third clips 50 and 60. The second stop member extends along an edge of the inner end 56 of the respective frame members 18, 20 and is effective to restrain longitudinal motion of the headrest covers 21, 23 toward the outer end 17 of the frame members 18, 20 that is, away from the patient support 14.

FIG. 3 illustrates an alternative fourth clip 64 located on the inside lateral edge 44 of the connector 30 proximate its outer end 42. The fourth clip 64 extends from the inside lateral edge 44 around the inside edge 48 and over the lower surface 37 of the respective frame members 18, 20. The fourth clip is effective to further secure each headrest cover to its respective frame member by capturing the frame member between the second and fourth clips 52 and 64, respectively.

The connector 30 may be thermal formed from ABS plastic material having a starting gage in the range of from 0.040 inches (1 mm) up to 0.062 inches (1.6 mm). The second and fourth clips 52 and 64 have flexibly resilient tabs 68 and 70, respectively, that may be bent or moved away from the lower surface 34 of the connector 30. However, upon releasing the tabs they spring back to their original position with respect to the lower connector surface 34. The clips 50 and 60 are preferably substantially longer than the clips 52 and 64; however, they may be the same length. While clips 50 and 60 have the same flexibly resilient characteristics, preferably they are substantially more rigid than the clips 52 and 64. The upper surface 32 of the connector 30 may be bonded to the lower surface 28 of the pad 24 with an ABS cement.

The mounting of the headrest covers on their respective frame members is identical and is described with respect to headrest cover 21. Headrest cover 21 is mounted on the frame member 18 by positioning first ends 66 and 67 of the first and third clips 50 and 60, respectively, adjacent the inner end 56 of the frame member 18 with the surfaces 34 and 36 adjacent each other. Next, the inner end 56 of the frame member 18 is inserted between and within the first and third clips 50 and 60, respectively, of the connector 30. The headrest cover 21 is then moved longitudinally relative to the frame member 18 toward the outer end 17 of the frame member 18. That motion engages the inner end 56 of the frame member between and within the first and third clips 50 and 60, respectively, thereby securing the inner end 40 of the connector, and hence that end of the headrest cover 10, with respect to the inner end 56 of the frame member 18.

Next, the tab 68 of the second clip 52 is flexed outwardly away from the upper surface 32 of the connector 30. The tab 68 is then moved around the outside edge 46 of the frame member 18 and over the lower frame surface 37. That step secures the first end 42 of the headrest cover to the outer end 17 of the frame member 18. In a similar manner, the tab 70 of the fourth clip 64 is bent outwardly away from the lower surface 34 of the connector 30 and thereafter moved around the inside edge 48 and over the lower surface 37 of the frame member 18, thereby further securing the one end 42 of the headrest cover 21 to the outer end 1 7 of the frame member 18.

While the present invention has been illustrated by the description of embodiments, and while the embodiments have been described in some detail, it is not the intention of the applicant to restrict or in any way limit the scope of the appended claims to such detail. Additional advantages and modifications will readily appear to those skilled in the art. For example, preferably, the connector is constructed with the first, second and third clips 50, 52 and 60, respectively, and the first and second stop members 58 and 62, respectively. The second stop member 62 may be removed. The fourth clip 64 may be added. The extent to which the inside and outside lateral edges 38 and 44, respectively, of the connector extend along the inside and outside edges 48 and 46, respectively, of a frame member can vary with different designs. The lengths and stiffness of the clips may vary. The extent to which the clips extend over the lower frame surface 37 may vary. The stiffness and resiliency of the clips 52 and 60 may differ from the clips 52 and 64. The invention in its broadest aspects is therefore not limited to the specific details shown and described. Accordingly, departures may be made from such details without departing from the spirit or scope of applicant's general inventive concept.

What is claimed is:

1. A headrest cover of the type for use with a frame member of a headrest, the frame member having an upper surface for supporting a head and a lower surface, the frame member further having inside and outside edges approximately parallel to a longitudinal axis of the frame, and the frame member including an upper end proximate an upper area of the head and a distal end, the headrest cover comprising:

a pad having an upper pad surface for receiving the head and a lower pad surface; and a connector having an upper connector surface connected to said lower pad surface, a lower surface adapted to contact the upper surface of the frame, first and second lateral edges approximately parallel to a longitudinal axis of said connector, first and second ends approximately transverse to said longitudinal axis of said connector and extending between said first and second lateral edges, said second end of said connector adapted to be proximate the upper end of the frame member, a first clip located on said first lateral edge of said connector proximate said first end, said first clip adapted to extend from said first lateral edge around the outside edge of the frame member and over the lower surface of the frame member, and a second flexibly resilient clip located on said first lateral edge of said connector proximate said second end, said second clip adapted to extend from said first lateral edge around the outside edge of the frame member and over the lower surface of the frame member a third clip located on said second lateral edge of said connector proximate said first end, said third clip adapted to extend from said second lateral edge around the inside edge of the frame member and over the lower surface of the frame member; and a first stop member extending from said second end of said connector and adapted to extend along an edge of the upper end of the frame member, thereby securing the headrest cover from motion in a direction toward the distal end of the frame member.

2. The headrest cover of claim 1 wherein said first lateral edge of said connector extends along and is adapted to be in a contacting relationship with the outside edge of the frame member.

3. The headrest cover of claim 1 wherein said third clip is located on said second lateral edge approximately opposite said first clip.

4. The headrest cover of claim 3 wherein said first and third clips are approximately the same size.

5. The headrest cover of claim 1 wherein said connector further includes a second stop member extending from said first end of said connector and adapted to extend along an edge of the distal end of the frame member, thereby securing the headrest cover from motion in a direction toward the upper end of the frame member.

6. The headrest cover of claim 5 wherein said connector further includes a fourth clip located on said second lateral edge of said connector proximate said second end of said connector, said fourth clip adapted to extend from said second lateral edge around the inside edge of the frame member and over the lower surface of the frame member.

7. The headrest cover of claim 6 wherein said fourth clip is located on said second lateral edge approximately opposite said second clip.

8. The headrest cover of claim 7 wherein said second and fourth clips are approximately the same size.

9. The headrest cover of claim 8 wherein said first and third clips are substantially longer than said second and fourth clips.

10. The headrest cover of claim 6 wherein said second lateral edge of said connector is adapted to extend along and in a contacting relationship with the inside edge of the frame member.

11. A connector for connecting a headrest cover to a frame member of a headrest, the frame member having upper and distal ends and an upper surface for supporting a head and a lower surface, the frame member further having inside and outside longitudinal edges and the headrest cover having a pad with an upper pad surface generally configured to receive the head and a lower pad surface, the connector comprising:

first and second ends;

an upper connector surface between said first and second ends and adapted to be connected to the lower pad surface;

a lower connector surface opposite said upper connector surface and adapted to contact the upper surface of the frame member;

first and second lateral edges partially bounding said lower connector surface;

a first clip located proximate said first end and adapted to extend from said first lateral edge around the outside longitudinal edge and over the lower surface of the frame member; and a second flexibly resilient clip located proximate said second end of the connector and adapted to extend from said first lateral edge around the outside longitudinal edge and over the lower surface of the frame member;

a third clip located opposite said first clip at said first end of the connector and adapted to extend from said second lateral edge around the inside longitudinal edge and over the lower surface of the frame member; and a stop member located on said second end of the connector and adapted to extend along an edge of the upper end of the frame member.

12. The connector of claim 11 further including a stop member located on said first end of the connector and adapted to extend along an edge of the distal end of the frame member.

13. The connector of claim 12 further including a fourth clip located proximate said second end of the connector and adapted to extend from said second lateral edge around the inside longitudinal edge and over the lower surface of the frame member.

* * * * *